US006848385B2

(12) United States Patent
Mah

(10) Patent No.: US 6,848,385 B2
(45) Date of Patent: Feb. 1, 2005

(54) UNDERWATER MOTIVE DEVICE

(76) Inventor: Pat Y. Mah, 8C Leroy Plaza, 15 Cheung Shun Street, Cheung Sha Wan, Kowloon, Hong Kong (CN)

( * ) Notice: Subject to any disclaimer, the term of this patent is extended or adjusted under 35 U.S.C. 154(b) by 0 days.

(21) Appl. No.: 10/280,625

(22) Filed: Oct. 25, 2002

(65) Prior Publication Data

US 2004/0079272 A1 Apr. 29, 2004

(51) Int. Cl.[7] ..... B63C 11/46
(52) U.S. Cl. ..... 114/315; 440/6
(58) Field of Search ..... 114/315, 312, 114/121, 125; 440/6

(56) References Cited

U.S. PATENT DOCUMENTS 3,789,788 A * 2/1974 Peroni ..... 114/315
5,379,714 A * 1/1995 Lewis et al. ..... 114/315

* cited by examiner

*Primary Examiner*—Ed Swinehart
(74) *Attorney, Agent, or Firm*—Curtis L. Harrington

(57) ABSTRACT

An underwater motive device utilizes a plastic rear housing which includes a battery storage space sealed with a tight fit to provide sealing, a pressured removal system is provided to pressurize the sealed battery chamber to enable the front wall to be removed. The motor is microprocessor controlled for safety by providing a slight delay before energizing the motor, and by providing some time in residence at a slow speed before switching to a higher speed. The result is a safe underwater motive device which will not accidentally become power actuated before the user is able to securely grasp and direct it, and which will not go to full speed except from a low speed to give the user a chance to stabilize himself in the water. Further, the control circuitry includes other features to provide both long battery life, good serviceable usage and battery preservation and motor preservation.

8 Claims, 5 Drawing Sheets

UNDERWATER MOTIVE DEVICE

FIELD OF THE INVENTION

The present invention relates to improvements in the technology relating to in water and underwater mechanical motive structures and particularly to improvements relating to a battery powered device for propelling swimmers and divers forward.

BACKGROUND OF THE INVENTION

Underwater motive devices have been known since the 1950's. Most of those earlier devices were metal and were built like small submarines. Access was had through hatches which had to be securely bolted or clamped in order to resist taking on water at depth. As a result, the underwater motive devices were large, bulky and designed with a mind to limit outside access to limit the sealing areas provided for service access.

The early underwater motive devices were also expensive, and heavy such that the only effective market was professional divers because of both the cost and strength required to handle the unit under water. Because of the sealed nature of the units, rechargeablility caused considerable time in opening, inspecting and re-sealing the units.

Further, because early underwater motive devices were meant for serious under water work the full power of the unit was made instantly available in order to enable a sealed actuation switch to be provided through the wall of the unit to the outside. Instant-on full power was another reason that the early underwater motive devices were dangerous due to increased lack of controllability. The user had to be skillful to avoid being raked by nearby objects in addition to other user problems.

Another early problem was ballast. Most underwater motive devices were built for salt water density, but density can change from ocean to ocean (the Persian Gulf is saltier) and based upon water temperature. Adjusting the ballast was a problem because each time an adjustment was desired to be made, it involved a complicated breaching of the sealed outer housing.

What is needed is a underwater motive device which is (1) safer, (2) more easily ballast weighted, (3) more easily recharged and serviced, and (4) which is light weight and portable.

SUMMARY OF THE INVENTION

An underwater motive device utilizes a plastic rear housing which includes a battery storage space which is "o" ring sealable with a front wall. Because the "o" ring seal is multiple and of tight fit to provide sealing, a pressured removal system is provided to pressurize the sealed battery chamber to enable the front wall to be removed. The battery is not only readily accessible for charging or replacement, but the front wall is easily removed and replaced. The motor is microprocessor controlled for safety by providing a slight delay before energizing the motor, and by providing some time in residence at a slow speed before switching to a higher speed. The result is a safe underwater motive device which will not accidentally become power actuated before the user is able to securely grasp and direct it, and which will not go to full speed except from a low speed to give the user a chance to stabilize himself in the water. Further, the control circuitry includes other features to provide both long battery life, good serviceable usage and battery preservation and motor preservation. The control circuit preferably constantly monitors the current through the motor and shuts down the motor if the current rises above a predetermined level. The circuit preferably constantly monitors the battery voltage and shuts down if the voltage is less than a predetermined level. The circuit preferably constantly measures the temperature of the motor and shuts down if the temperature is above a certain predetermined level. Further, the circuit will preferably constantly measure the rate of change of the current and shut down of the rate of change of current is above a predetermined level, the rate change being either positive (increasing current) or negative (decreasing current). Further, the circuit uses two reed switches that can be independently switched to their conducting state and it is preferred that both must be conducting for the motor to be switched on.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
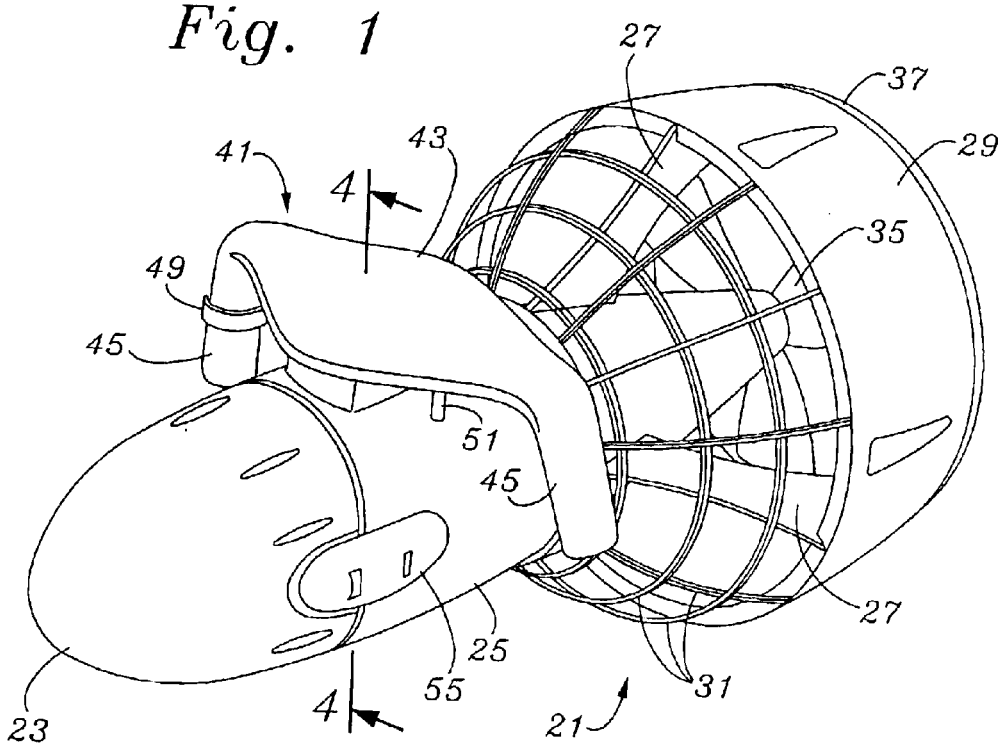
FIG. 1 is a perspective view of the underwater motive device of the present invention.

The description and operation of the invention will be best initiated with reference to FIG. 1. An underwater motive device 21 has housing members including a front cone 23 and rear main housing 25. From the rear main housing 25 a number of fan housing supports 27 support a fan housing 29. In addition to the fan housing supports 27, a cage 31 provides stability to the fan housing 29, and is supported by it.

The rear main housing 25 extends somewhat rearwardly of the cage 31 and rotatably supports a propeller 35. A rearmost screen guard 37 is only partially see at the rearward rim of the fan housing 29 and is excluded from being shown adjacent the propeller 35 for clarity.

At the top of the rear main housing 25 is a handle bar support 41 which includes a top generally hydrodynamic area 43 leading to a pair of oppositely disposed handle bars 45 which are angled slightly rearwardly along their downward path extent. The handle bars 45 are intended to be grasped with the underwater motive device 21 held generally near the user's chest with elbows somewhat tucked in and on either side of the fan housing 29.

A manual switch 49 has a curvature partially covering the front of one of the handle bars 45 for easy access and grasping. A rotatable slender selector switch 51 is mounted to pivot in a generally horizontal plane underneath the handle bar 45 opposite the switch 49. Both switches 49 and 51 are pivot structures mounted with fittings which naturally resist the water side pressure. Both switches 49 and 51 may have an internal component as a reed switch to further isolate the electrical circuitry, especially switch components from contact with any water. The handle bar support 41 is meant to flood as it removes itself as a bouyancy consideration. Rotatable slender selector switch 51 therefore may have associated with it a high degree of arc for operation in order to visually verify its orientation. Further, once familiarity is had with the "on" and "off" position, the user does not have to be able to view a position of a typical on and off switch closely, which would lead to confusion and mistake as to the switch's state.

The front cone 23 has a pair of swinging latches 55 which pivot about an insertion point in the front cone 23 and which engage a locking structure (not seen in FIG. 1) on the rear main housing 25, to insure that the front cone 23 is held securely in place. The latches 55 may preferably have ramps and grooves on their locating faces to ensure the latches are in an over center position when locked. This swing latch mechanism, as will be seen, also serves as a secondary gauge to insure that the internals of the underwater motive device 21 are properly and securely held in place. The sealing system avoids the use of face sealing so that latching is less troublesome and involves minimum force.

Figure 2:
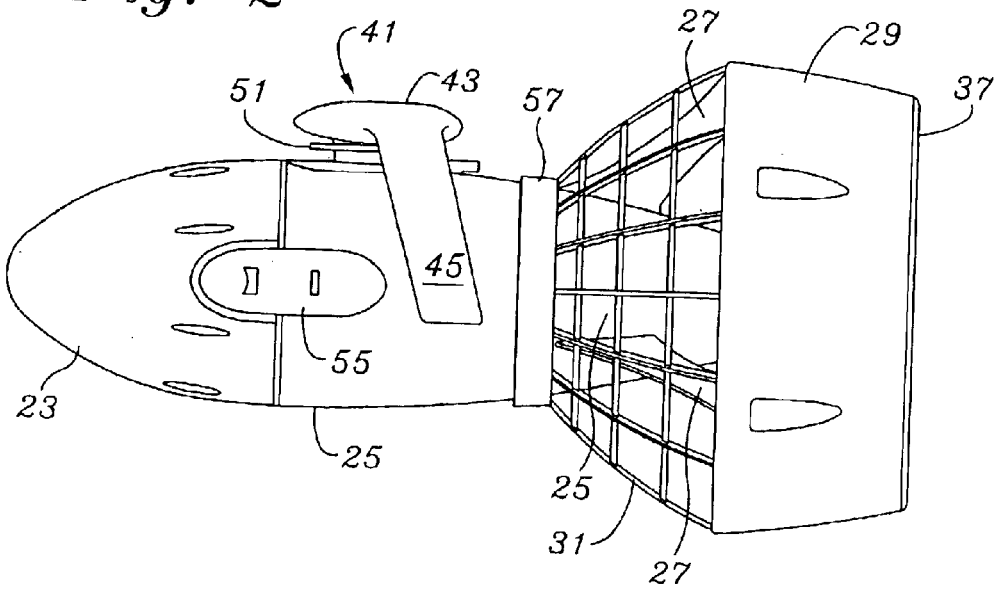
FIG. 2 is a side view of the underwater motive device of FIG. 1.

Referring to FIG. 2, a side view enables a better view of many of the structures seen in FIG. 1, particularly the placement of the handle bars 45. Seen also is a front ring 57 which supports the cage 31 which is suspended between the fan housing 29 and the front ring 57.

Figure 3:
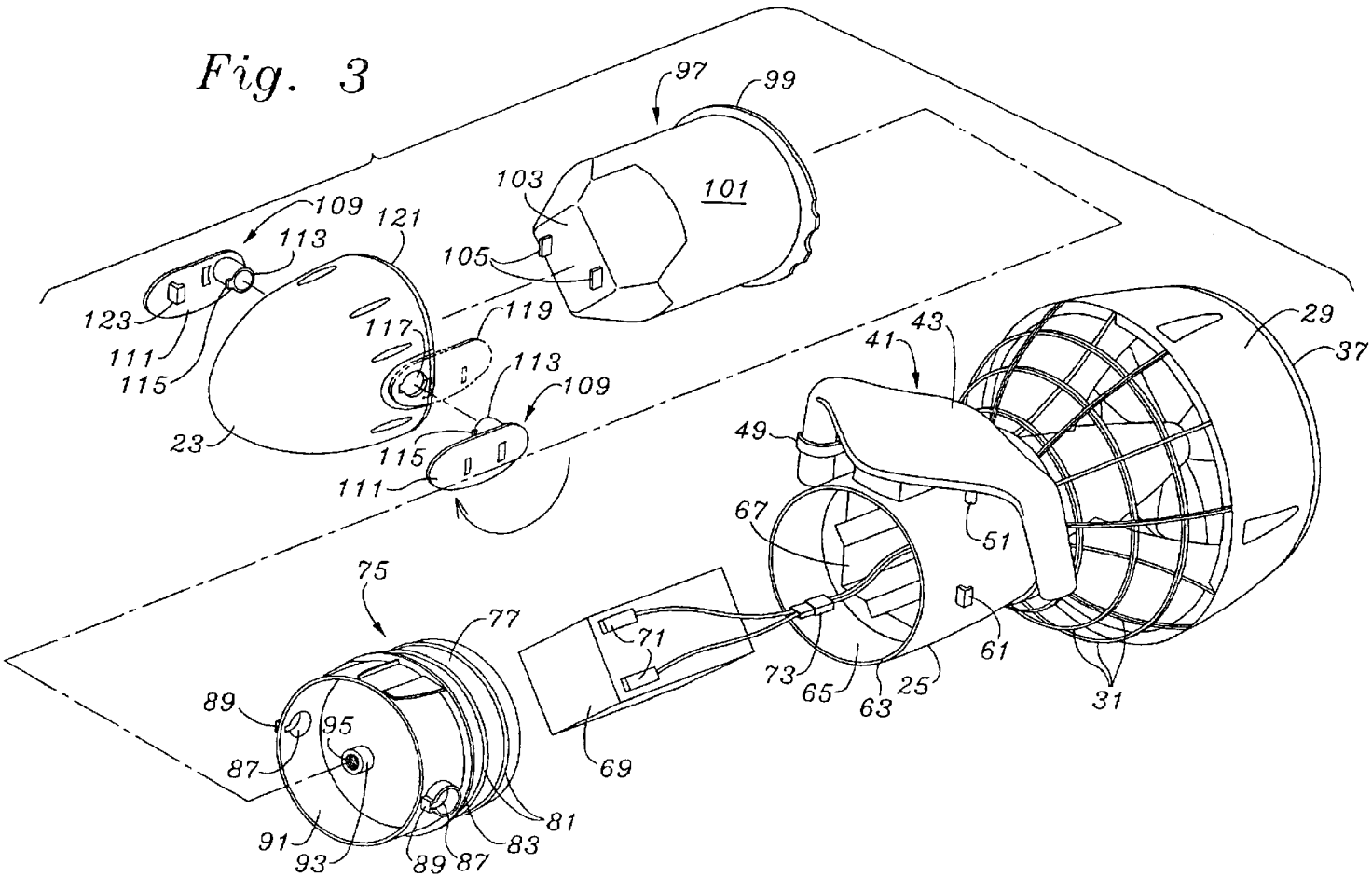
FIG. 3 is an exploded view of the underwater motive device of FIGS. 1 and 2.

Referring to FIG. 3, a user's exploded view illustrates the access which a user has to both provide for ballast and for battery change out or recharge. Beginning at the right, the rear main housing 25 is seen as having a latch projection 61 which extends outward and rearward and has sufficient thickness and base for a good mechanical holding force. To the left of the latch projection 61 is seen a rim 63 exposed when the front cone 23 is removed. Adjacent the rim 63 is a relatively deep somewhat cylindrically shaped, actually an elliptical area 65 which forms a sealing surface and which leads to a shaped area 67 which is circumferentially inward of the ellipitical area 65 at a point deeper within the rear main housing 65. This area is shaped to accommodate two rectangular battery sizes with the portions of the shaped area 67 which deviate from rectangularity on one orientation to provide a slot for wire and attachment accommodation using the rectangular shape in the another orientation.

A battery 69 is shown connected by a pair of slide terminals to a wire set and connector 73 leading into the front opening of the rear main housing 25 past the rim 63. Utilizing this basic configuration, the battery 69 can be easily grasped and extracted from the shaped area 67 and can be easily replaced without much interference from the wire set and connector 73.

Just ahead of the battery 69, a sealing structure 75 is seen. Sealing structure 75 has a rear cylindrical portion 77 which includes several "o" ring type projections 81, two of which are seen on the rear cylindrical portion 77. Even without the "o" ring type projections 81, the rear cylindrical portion 77 forms a close fit with the relatively deep ellipitical area 65 with the "o" ring type projections 81 set to engage the surface of the relatively deep ellipitical area 65 to more completely form a seal. The area beyond the shaped area 67 and rearward of the rear main housing 25 is designed to be sealed utilizing other structures, including the motor and drive shaft(not shown).

Sealing structure 75 also includes a flange 83 which sets, along with the length of the relatively deep ellipitical area 65 matched with the rear cylindrical portion 77, the depth with which the sealing structure 75 can enter inside of the rear main housing 25. Ahead of the flange 83, a pair of key apertures 87 are surrounded by outwardly extending keyed bosses 89. The key shape enables a non cylindrical shape to enter and lock when not in its entry alignment. As will be seen, the key apertures 87 will be used to lock the sealing structure 75 back against the rear main housing 25.

The front of the sealing structure 75 includes a cylindrical forward wall 91 which protects and covers a center fitting 93. The center fitting 93 is a valve which permits entry of air upon having an air fitting inserted in an aperture 95 of the fitting. Any type of valve is permissible such as a flapper valve or the device can work well without any valve as the seal between the fitting 93 and an inserted tube during pressurization is all that is necessary to provide a pressurized assist to remove the sealing structure 75.

Even where no valve is used, the placement of the fitting 95 is so as to allow very little or no fluid flow to the rear of the sealing structure 75. Since the volume behind the sealing structure 75 is pressure tight, a significant amount of water would have to enter to fill the area about the fitting 93 and beyond the height of the fitting 93. Further, as will be seen, a ballast structure is provided which further restricts the amount of access to the fitting 93 and further restricts the displacement which can occur in the front cone 23.

Because the rear cylindrical portion 77 and the relatively deep ellipitical area 65 have so much common area and provide such a strong seal, the frictional interaction creates a significant force required to separate the sealing structure 75 from the rear cylindrical portion 77. Because of the profile of the underwater motive device 21 and due to its small size the lack of structures to which significant manual force can be applied, the pressurized assist works well for separation. Further, where a shutting valve is provided within the fitting 93, partial pressurization can be applied to further preclude any leakage through the fitting 93.

Forward of the sealing structure 75, a shaped ballast 97 is seen. Ballast 97 includes a rear shaped rim 99 and a cup shaped forward portion 101. A front surface 103 includes a pair of projections 105 for location on top of the handle bars 45 when ballast is adjusted. The rear of the ballast 97 (not seen in FIG. 3) includes an indentation to accommodate the protrusion of the fitting 93. The indentation (not shown in FIG. 3) also provides a sealing cap to enable the ballast 97 to be controllably filled with water to set the degree of ballast desired. This is particularly important where uses change from salt to fresh water usage.

Also seen is a pair of insertable latch and lock dogs 109. Each lock dog 109 includes a relatively planar portion 111 to which an annular keyed plug 113 is attached at a right angle. A key projection 115 extends from the annular keyed plug 113 only at its most distal end, away from the relatively planar portion 111, in order to enable it to rotate after entering the key apertures 87.

Also seen on the front cone 23 are a pair of keyed side apertures 117, only one of which is seen in FIG. 3. A phantom view of a latch and lock dog 109 is shown in dashed format and identified with the numeral 119 and is shown in its inserted and rotated position. In this rearwardly extending (with respect to cone 23) position, the insertable latch and lock dog 109 engages the latch projection 61 to hold the front cone 23 in place. However, the latch and lock dog 109 also engaged the keyed aperture 87 and utilizes that structure to achieve the whole of its depth of engagement.

In terms of assembly, and starting with the structures seen in FIG. 3, first the battery, preferably charged, is inserted into the shaped area 67. Next the rear cylindrical portion 77 of the sealing structure 75 is inserted into the rear main housing 25. The sealing structure 75 is inserted into the rear main housing 25 to its full extent, and until flange 83 makes even contact with rim 63.

Next, the ballast 101 is moved into position within the cylindrical forward wall 91 and over the center fitting 93 such that the rim 99 of the ballast 97 comes to rest beyond the level of the key apertures 87 within the cylindrical forward wall 91. Once the ballast 97 is brought to this position, any intrusion within the cylindrical forward wall 91 will further fix its position. Next, the front cone 23 is brought over the ballast 97 and over the outwardly extending keyed bosses 89 until a rearward rim 121 rests against the front side of the flange 83. The apertures 117 are brought into alignment with the key apertures 87 of the sealing structure 75.

Next, each annular keyed plug 113 of an insertable latch and lock dogs 109 is inserted through the aligned apertures 117 and key aperture 87. The orientation of the key projection 115 of the annular keyed plug 113 is oriented so that the relatively planar portion 111 is directed forward and away from the rim 121 upon insertion and so that it can then be rotated 180° to the rear to latch. Once the insertable latch and lock dogs 109 are rotated more than a few degrees, the front cone 23 and sealing structure 75 are locked together, with the rim 99 of the ballast 97 being secondarily trapped behind the inward projection of the annular keyed plug 113, and further locked down by the rotation of the tip end of the key projection 115 against a front face of the rim 99.

As the pair of insertable latch and lock dogs 109 are brought maximally rearward, at the point approaching about 170°, a latch member 123 is brought around the latch projection 61 extending from the rear main housing 25. Once brought to the 180° point the entire sealing structure 75 is locked onto the rear main housing 25. The latch and lock dogs 109 to an extent operate as an indicator that the sealing structure 75 is fully seated, as once seating occurs sealing structure 75 is difficult to remove. The pressure against the latch and lock dogs 109 once latched, will be minimal.

Figure 4:
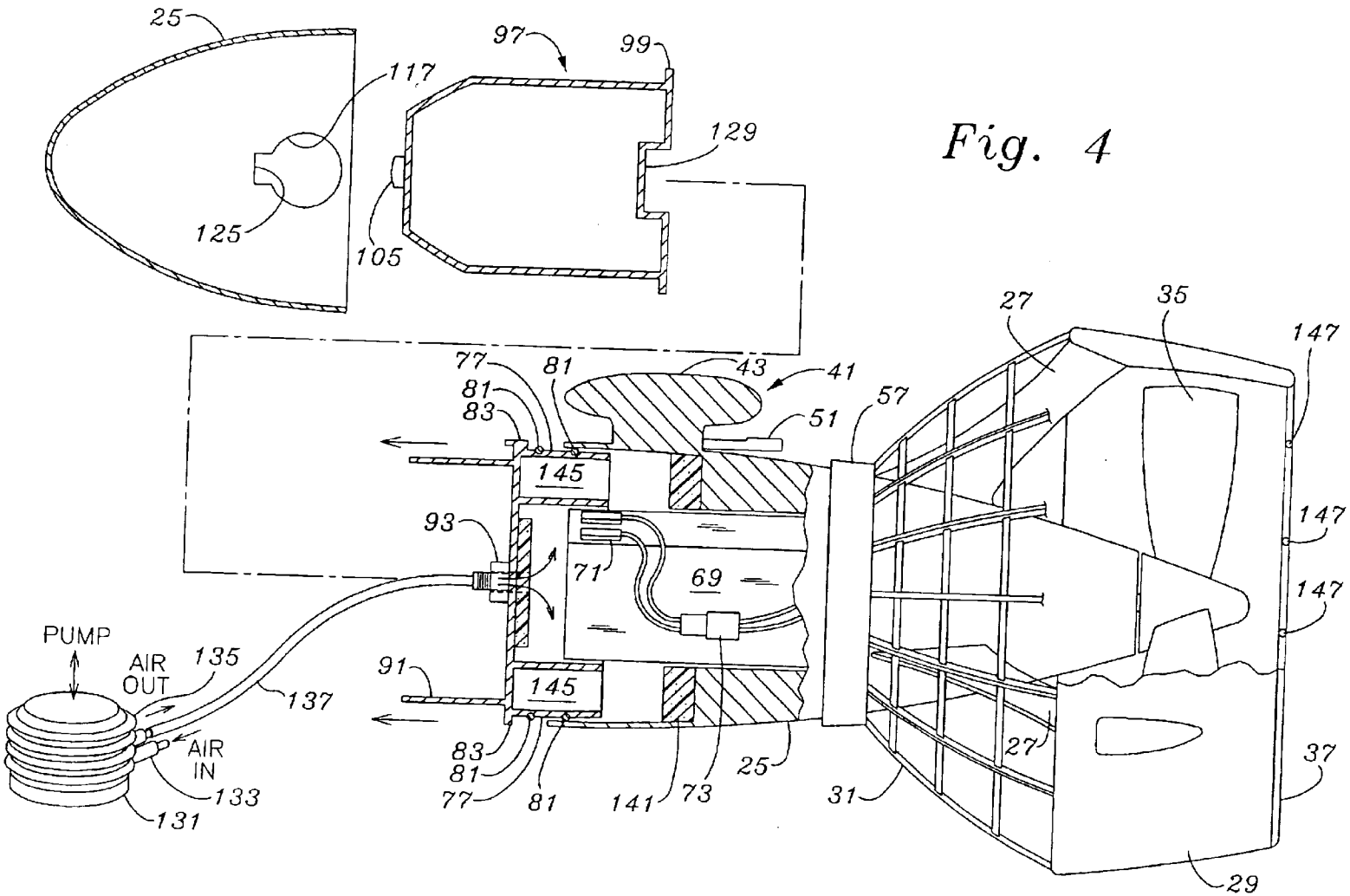
FIG. 4 is a partially exploded side sectional view of the underwater motive device of FIGS. 1–3 and illustrating the use of an air pump to provide internal pressure to overcome the friction of sealing in removal of a sealing member.

Referring to FIG. 4 a partial side sectional view is useful illustrating both the partial assembled view and an explanation of dis-assembly at least to the point of access of the battery. In gaining access with regard to the assembled versions seen in FIGS. 1 and 2, the latch and lock dogs 109 are rotated away from engagement with the latch projection 61 and to a full forward position rotated 180° from the locked position. As can be seen in FIG. 4, the keyed side apertures 117 include a flat portion 125 forming the key projection of the keyed side apertures 117. This provides clearance for the key projection 115 and enables complete removal of the latch and lock dogs 109.

The front cone 23 is then removed, along with the ballast 97. On the ballast 97 is seen an indentation 129 previously referred to which accommodates the protrusion of the fitting 93. Not shown on the ballast 97 in this side sectional view are the holes and closures for allowing water in and out to affect bouyancy and are generally situated to either side of the indentation 129. Indentation 129 also enables the ballast 97 to be better manually gripped.

Shown to the lower left of FIG. 4 is an air pump 131 having an inlet port 133 and an outlet port 135. A connection tube 137 leads from the outlet port 135 to the fitting 93. The air pump 131 need be no more than a simple plastic pump as the pressure developed need not be great, probably not more than 7–10 PSIG above ambient pressure. The force causes the sealing structure 75 to emerge from within the rear main housing 25. As such, no physical force needs to be expended on the sealing structure 75 and removal, even in the presence of strong, well fitting sealing surfaces, is facilitated. Once the sealing structure 75 is removed, normal access is had to the shaped area 67 and beyond.

Also seen in FIG. 4 is the possibility of a further, optional sealing member 141 which provides a further splash seal which causes any entering water to go around the rear edge of the member 75 and into an annular area 145 before having to negotiate the inside of the seal 141 to attempt to enter the area holding the battery. Also seen to the rear of the fan housing 29 are further details of the rearmost screen guard 37 including its cage members 147.

Figure 5:
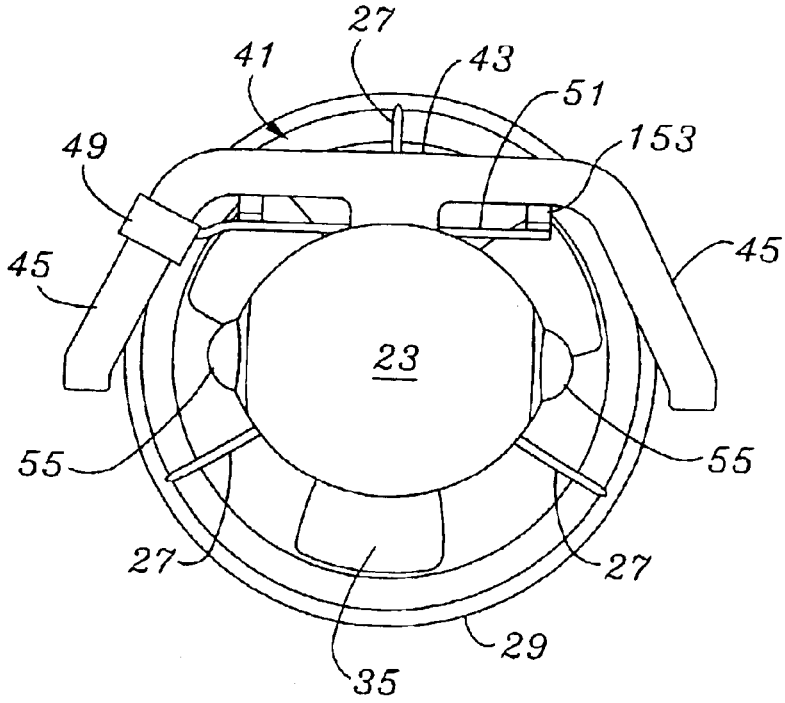
FIG. 5 is a front view of the underwater motive device of FIGS. 1–4.

Referring to FIG. 5, a front view gives a better illustration of the profile and orientation of the components of the underwater motive device 21. Here, the main body of the rearmost screen guard 37, as well as the cage 31, have been removed so that the components may be more readily identified without visual interference. The manual switch 49 and the rotatable slender selector switch 51 are seen to operate through a pair of bosses 151 and 153, respectively on the underside of the handle bar support 41. The use of the bosses 151 and 153 provide a stable support for the manual switch 49 and the rotatable slender selector switch 51 while limiting the physical access through the handle bar support 41. Further, the underside mounting helps to protect these structures from inadvertent impact with other objects as well as user impact, intentional or unintentional. The movement of the manual switch 49 is slight and the internals of the switch are set such that a small movement to depress the band portion of the manual switch 49 toward the handle bar 45 will trigger the start of the control sequence, and then powered motion of the propeller 35. A delay is typically a characteristic of the contol circuit. For the rotatable slender selector switch 51, and especially for visual notice, the rotation involved is nearly 160° so that the user has a definite indication of power ability. There are a number of "off" positions such as at 90°, 180° and more and any combination of possible positions may be used. The general idea is that the user can readily see the position of the switch.

Since the handle bar support 41 and oppositely disposed handle bars 45 are designed to flood, sealing is not needed. Further, the clearance can be significant to prevent buildup of sand, debris etc. The bosses 151 and 153 which provide a pull inward for the manual switch 49 and the rotatable slender selector switch 51. The fan housing supports 27 are shown prominently with the cage 31 having been removed for clarity.

Figure 6:
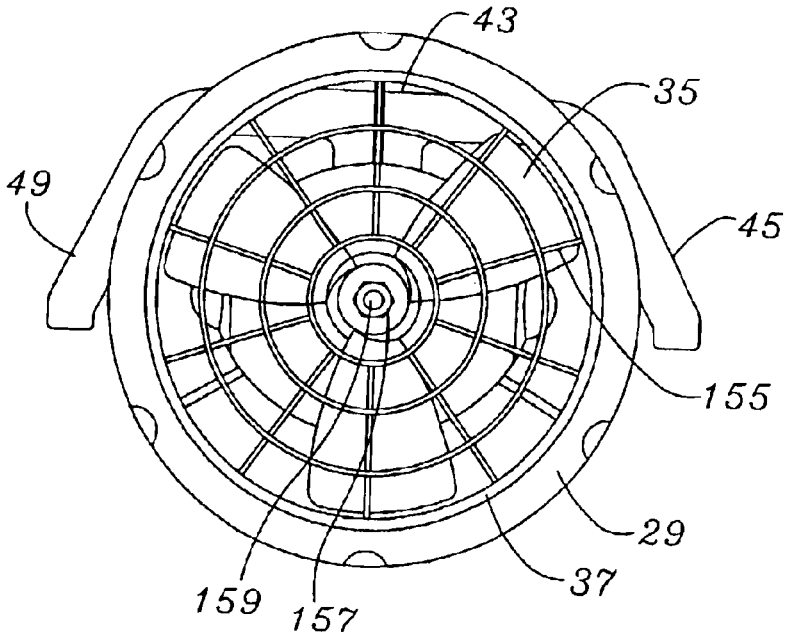
FIG. 6 is a rear view of the underwater motive device of FIGS. 1–5.

Referring to FIG. 6, a rear view of the underwater motive device 21 is shown with the rearmost screen guard 37 having a radial net member 155 shown in place to illustrate the manner in which any user contact with the propeller 35 is guarded against. The rearmost screen guard 37 should only be removed in order to service the propeller 35 and the nut 157 and bolt 159 fitting holding it into an operable supported relationship with the motor (not shown).

Figure 7:
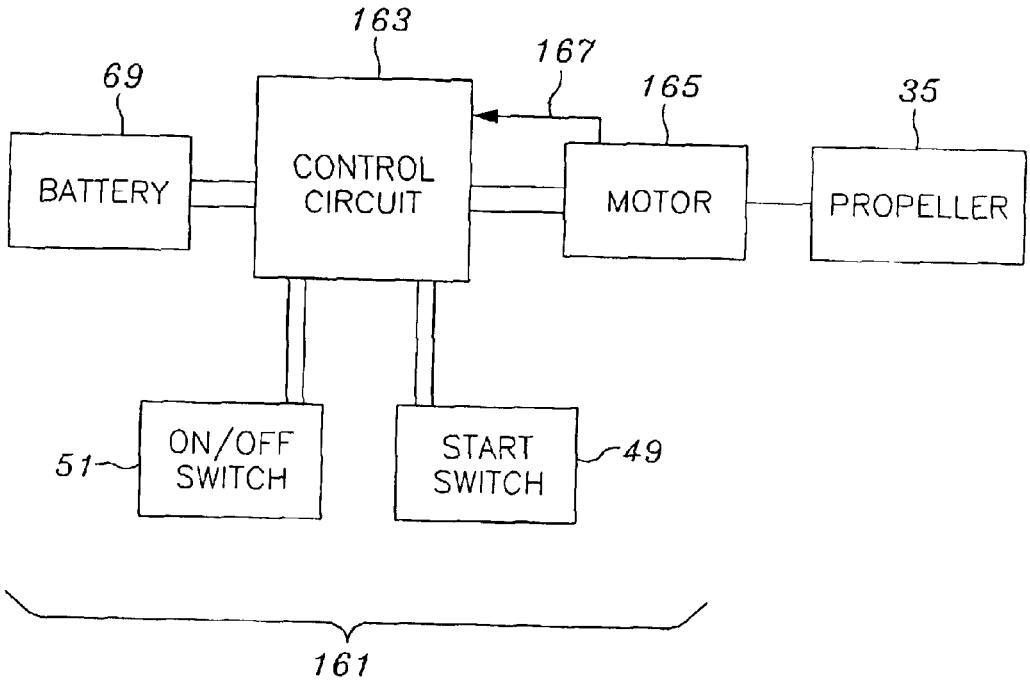
FIG. 7 is a block diagram schematic illustrating the relationship of the battery to a control circuit which performs a sequential safety control and measures current use.

Referring to FIG. 7, a block schematic diagram of a circuit control system 161 is shown. Battery 69 is connected to a CONTROL CIRCUIT 163 which provides a sequential control as well as feedback over-current control. A pair of connections provides direct current flow. The CONTROL CIRCUIT 163 is connected to the on and off switch 51 seen in the previous figures external to the underwater motive device 21 as rotatable slender selector switch 51. The CONTROL CIRCUIT 163 is also connected by a pair of connections to a start switch 49 seen as manual switch 49 in the previous figures.

The CONTROL CIRCUIT 163 has a pair of connections to a MOTOR 165. Feedback current control can be obtained by monitoring the pair of power lines or by monitoring a further feedback connection 167 which may be provided for sensing current, temperature and more at various points within the motor 165. The motor 165 is connected mechanically to the propeller 35 previously seen in the figures.

As can be seen, the on/off switch 51 is generally used to disable the operation of the underwater motive device 21 and acts as a master shut down switch, especially to prevent actuation when the underwater motive device 21 is out of the water and when it might come into contact with other structures.

The CONTROL CIRCUIT 163, once the switch 51 is closed and upon closure of the start switch, may provide a slight delay in time before energization of the motion 165. This will prevent the underwater motive device 21 from starting before a user is completely ready. Put another way, it gives the user a moment to make certain that the underwater motive device 21 handle bars 45 are securely grasped before forward movement. This will also insure that in the event that the user grasps the right handle bar 45 first and accidentally trips the manual switch 49 that the underwater motive device 21 will not instantly start at a point in time before the user is prepared.

Further temporal programming includes at least one of a ramped or stepper circuit to provide for increases in speed based upon the time since initial actuation. This serves to start the motor 165 at a relatively lower speed to end up with a relatively higher speed only after the user has been under way for a short time. The method of achieving the higher speeds can be by step or ramp. Step will give a definite power indication to the user, while a ramp function will cause the increase in speed to be gradual. This ramping avoids a lurch of power at startup.

In addition to motor 165 current detection, the CONTROL CIRCUIT 163 is enabled to limit or shut down the motor 165 if the current rises above a predetermined level. Further, the CONTROL CIRCUIT 163 preferably constantly monitors the battery 69 voltage and shuts down the motor 165 if the voltage falls below a predetermined level. The CONTROL CIRCUIT 163 can also preferably constantly measure the temperature of the motor 165 to shut it down if the motor 165 temperature is above a certain predetermined level.

In terms of utilization, the underwater motive device 21 offers advantages previously not seen in underwater motive devices. The swinging latches 55 provide an integrated quick method of disassembly, while the air assisted disassembly structure enables a high sealing structure. The ballast 97 can be trimmed by filling and emptying it achieve the desired ballast 97 weight. The ballast 97 can be attached to the handlebar 45 in order to allow the trimming to be carried out without the ballast 97 being in its normal position. The front grille is novel because it can be securely locked in position using a pair of simple quick release latch.

While the present invention has been described in terms of an underwater motive device, and more particularly to a particular structure and system which utilizes a control set which provides power delay and stepped or ramped power increase, this mechanism can be applied to other devices.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An underwater motive device comprising:

a rear main housing including a motor operably connected to a propeller;

a manual support attached to said rear main housing for manual grasping and manipulation of said underwater motive device with respect to a user;

a front cone removably attached to said rear main housing; and a switch operable from outside said rear main housing connected to and for controlling said motor;

a battery compartment located in at least one of said rear main housing and said front cone;

a removable water ballast located in at least the other of said rear main housing and said front cone; and a sealing structure interposed between said rear main housing and said front cone, and wherein said sealing structure further includes a pressure fitting to facilitate the entry of pressurized air into said rear main housing through said sealing structure to produce force tending to expel said sealing structure from said rear main housing.

2. The underwater motive device as recited in claim 1 wherein said propeller is at least partially enclosed by at least one of a cage and a screen to inhibit contact between said propeller and said user.

3. The underwater motive device as recited in claim 1 wherein said manual support is a handle bar support.

4. The underwater motive device as recited in claim 1 wherein said rear main housing includes an internal cylindrical area and wherein said sealing structure includes a rear cylindrical portion having at least one "o" ring surrounding said rear cylindrical portion, said rear cylindrical portion for fitting within said cylindrical area.

5. The underwater motive device as recited in claim 1 and further comprising a controller between said switch and said motor and wherein said controller is configured to accomplishing at least one of starting said propeller slowly for a time before increase to full speed; shutting down said motor based upon a monitoring the current through said motor; shutting down said motor based upon a monitoring a voltage level of said battery; shutting down said motor based upon a monitoring the temperature through said motor; and shutting down said motor based upon a monitoring the change in current through said motor.

6. The underwater motive device as recited in claim 1 and further comprising at least one external latch pivotally connected to at least one of said front cone and said rear main housing and engageable with the other of said front cone and said rear main housing to secure said front cone to said rear main housing.

7. The underwater motive device as recited in claim 1 and further comprising at least one external latch pivotally connected to said front cone and said sealing structure for securing said front cone to said sealing structure and for securing said front cone and said sealing structure to said rear main housing.

8. An underwater motive device comprising:

a rear main housing including a motor operably connected to a propeller;

a manual support attached to said rear main housing for manual grasping and manipulation of said underwater motive device with respect to a user;

a front cone removably attached to said rear main housing; and a switch operable from outside said rear main housing connected to and for controlling said motor;

a battery compartment located in at least one of said rear main housing and said front cone;

a removable water ballast located in at least the other of said rear main housing and said front cone; and a sealing structure interposed between said rear main housing and said front cone, and at least one external latch pivotally connected to said front cone and said sealing structure for securing said front cone to said sealing structure and for securing said front cone and said sealing structure to said rear main housing and wherein said pivotal connection of said at least one external latch is had through a keyhole aperture in at least said sealing structure.

* * * * *